United States Patent [19]

Heleen et al.

[11] Patent Number: 4,840,319

[45] Date of Patent: Jun. 20, 1989

[54] BAG TIE DISPENSER

[76] Inventors: Harold E. Heleen; Lucille M. Heleen, both of P.O. Box 21, Thomasville, Ga. 31799-021

[21] Appl. No.: 149,359

[22] Filed: Jan. 28, 1988

[51] Int. Cl.[4] ..... B65H 19/00; G03B 1/24

[52] U.S. Cl. ..... 242/55.53; 226/76

[58] Field of Search ..... 242/55.2, 55.3, 55.53; 226/76, 77, 168; 225/10, 15, 16, 46, 53, 54, 106; 156/563

[56] References Cited

U.S. PATENT DOCUMENTS

| | | | |
|---|---|---|---|
| 2,125,754 | 8/1938 | Steiner | 225/14 |
| 3,007,177 | 11/1961 | Jackson et al. | 242/55.53 |
| 3,417,863 | 12/1968 | Paxton . | |
| 3,420,464 | 1/1969 | Rudzitis et al. | 226/76 X |
| 3,718,251 | 2/1973 | Barnett . | |
| 3,777,400 | 12/1973 | Klinz et al. . | |
| 3,810,407 | 5/1974 | Klund et al. | 226/76 X |
| 3,857,139 | 12/1974 | Turner . | |
| 3,919,038 | 11/1975 | Davis | 156/563 X |
| 3,973,294 | 8/1976 | Pfizenmaier . | |

*Primary Examiner*—Daniel P. Stodola
*Assistant Examiner*—John M. Eghtessad
*Attorney, Agent, or Firm*—Jerry T. Kearns

[57] ABSTRACT

A dispenser for manually dispensing wire bag tie closure strips has a hollow housing having a feed hopper communicating with a transverse cylindrical recess. A removable lid is received on a top portion of the housing. The lid forms an open receptacle for loose bag tie closure strips. A slotted feed roller is rotatably mounted in the cylindrical recess. An exterior control knob is connected for manual rotation of the feed roller for dispensing bag tie closure strips through a horizontal slot formed in a front wall of the housing. A pawl and rachet mechanism is utilized to allow only one bag tie closure strip to be dispensed at a time. An aperture is formed through the front housing wall and is provided with a slidable cover. The aperture is utilized for initially aligning a series of interconnected bag tie closure strips with the slotted feed roller. An adhesive strip is provided on a back exterior wall of the housing for securing the dispenser to a vertical surface.

3 Claims, 3 Drawing Sheets

BAG TIE DISPENSER

BACKGROUND OF THE INVENTION

1. Field of the Invention

The present invention relates to dispensers, and more particularly pertains to a new and improved dispenser for wire bag tie closure strips. Plastic bags such as waste basket liners and food storage bags are marketed in packages including a series of interconnected wire bag tie closure strips. When utilizing these plastic bags, it is difficult to remove only one closure strip from these series of interconnected closure strips. Additionally, these closure strips are frequently misplaced and thus become unavailable when urgently needed. In order to overcome these problems, the present invention provides a dispenser adapted to conveniently store and dispense these wire bag tie closure strips.

2. Description of the Prior Art

Various types of dispensers are known in the prior art. A typical example of such a dispenser is to be found in U.S. Pat. No. 3,417,863, which issued to J. Paxton on Dec. 24, 1968. This patent discloses a dispenser for plastic bags and attached closure strips. Each plastic bag of a stack is provided with an adhesively attached individual wire bag closure strip. U.S. Pat. No. 3,718,251, which issued to K. Barnett on Feb. 27, 1973, discloses a combined package and dispenser for rolled plastic bags. A bag roll is enclosed within a container and the container has die cut openings on one face to pass the heads of nails driven into a wall for supporting the container upon the wall. The bags may be drawn through an opening in the container. A pair of combined end plates and roll supports are positioned in the container at opposite ends of the roll for reinforcing and rotatably supporting the roll. U.S. Pat. No. 3,777,400, which issued to K. Klenz et al on Dec. 11, 1973, discloses a clipping device for forming a closure around the neck of a bag. Clips are supplied to the apparatus in the form of an elongated pre-stamped strip of planar sheet material which is wound on a supply reel. Individual clips are cut from the strip by a punch, which in cooperation with a die, applies the clip around the neck of a bag. U.S. Pat. No. 3,857,139, which issued to J. Turner on Dec. 31, 1974, discloses a colored twist tie to provide an air tight closure for one end of a plastic bag. The tie strip is color coded for indicating the processing date of the packaged product. U.S. Pat. No. 3,973,294, which issued to W. Pfizenmaier on Aug. 10, 1976, discloses a closure strip for plastic bags which are cut from an elongated web. Each closure strip comprises one or more wire elements extending longitudinally of the strip and a large flat area on which information about the packaged contents may be provided.

While the above mentioned devices are suited for their intended usage, none of these devices provide a dispenser suitable for home usage by consumers in dispensing wire bag tie closure strips. Additionally, none of the aforesaid devices provide a dispenser which utilizes a carefully dimensioned slotted feed roller for dispensing a series of interconnected closure strips in a one at a time manner. Inasmuch as the art is relatively crowded with respect to these various types of dispensers, it can be appreciated that there is a continuing need for and interest in improvements to such dispensers, and in this respect, the present invention addresses this need and interest.

SUMMARY OF THE INVENTION

In view of the foregoing disadvantages inherent in the known types of dispensers now present in the prior art, the present invention provides an improved bag tie dispenser. As such, the general purpose of the present invention, which will be described subsequently in greater detail, is to provide a new and improved bag tie dispenser which has all the advantages of the prior art dispensers and none of the disadvantages.

To attain this, a representative embodiments of the concepts of the present invention is illustrated in the drawings and makes use of a dispenser for manually dispensing wire bag tie closure strips which has a hollow housing having a feed hopper communicating with a transverse cylindrical recess. A removable lid is received on a top portion of the housing. The lid forms an open receptacle for loose bag tie closure strips. A slotted feed roller is rotatably mounted in the cylindrical recess. An exterior control knob is connected for manual rotation of the feed roller for dispensing bag tie closure strips through a horizontal slot formed in a front wall of the housing. A pawl and ratchet mechanism is utilized to allow only one bag tie closure strip to be dispensed at a time. An aperture is formed through the front housing wall and is provided with a slidable cover. The aperture is utilized for initially aligning a series of interconnected bag tie closure strips with the slotted feed roller. An adhesive strip is provided on a back exterior wall of the housing for securing the dispenser to a vertical surface.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting. As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved bag tie dispenser which has all the advantages of the prior art dispensers and none of the disadvantages.

It is another object of the present invention to provide a new and improved bag tie dispenser which may be easily and efficiently manufactured and marketed.

It is a further object of the present invention to provide a new and improved bag tie dispenser which is of a durable and reliable construction.

An even further object of the present invention is to provide a new and improved bag tie dispenser which is susceptible of a low cost of manufacture with regard to both materials and labor, and which accordingly is then susceptible of low prices of sale to the consuming public, thereby making such dispensers economically available to the buying public.

Still yet another object of the present invention is to provide a new and improved bag tie dispenser which provides in the apparatuses and methods of the prior art some of the advantages thereof, while simultaneously overcoming some of the disadvantage normally associated therewith.

Still another object of the present invention is to provide a new and improved bag tie dispenser for dispensing a series of interconnected wire bag tie closure strips in a one at a time manner.

Yet another object of the present invention is to provide a new and improved bag tie dispenser which utilizes a carefully dimensioned slotted feed roller for storing and dispensing bag tie closure strips.

Even still another object of the present invention is to provide a new and improved bag tie dispenser which utilizes a pawl and ratchet mechanism for dispensing bag tie closure strips in a one at a time manner.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
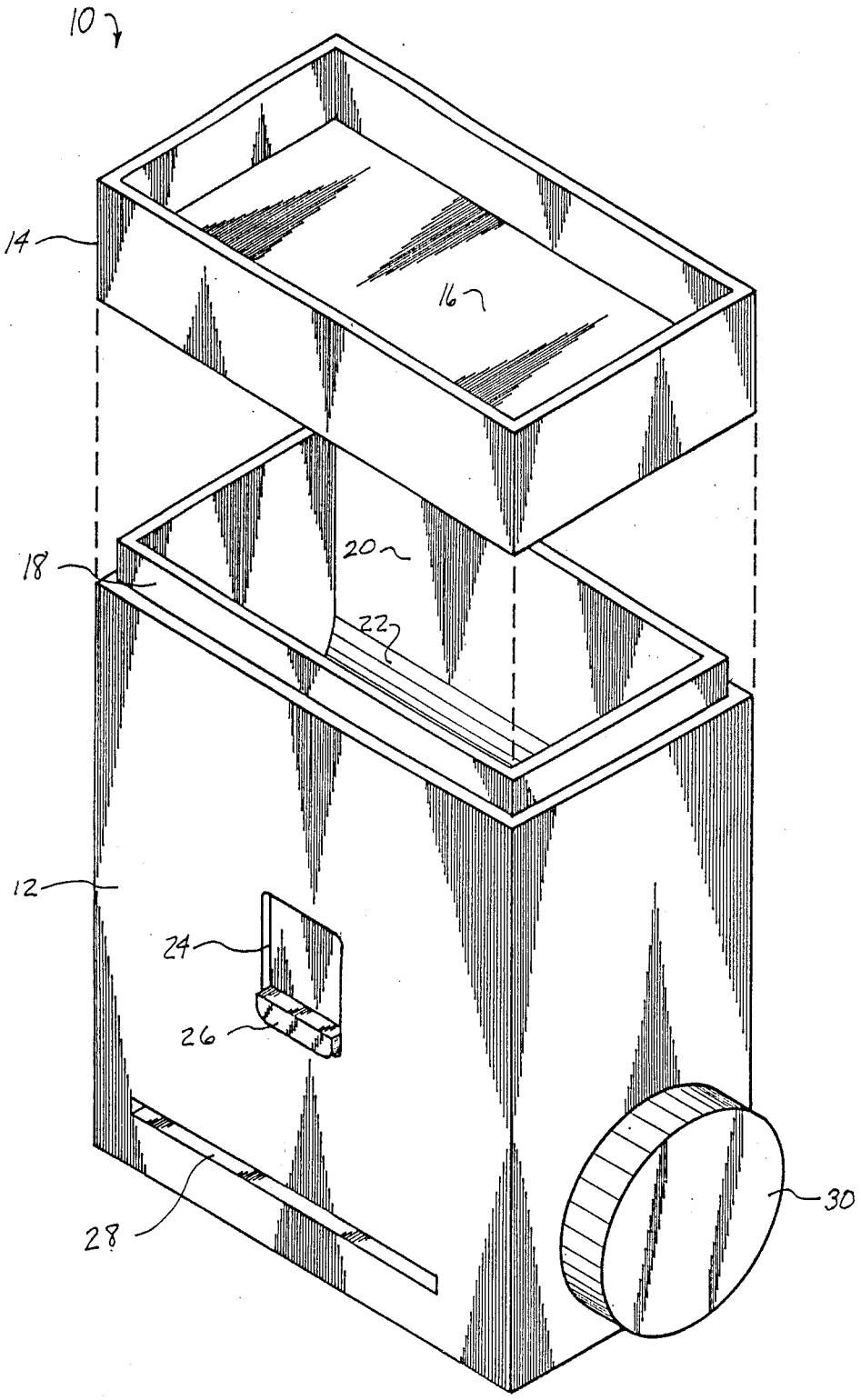
FIG. 1 is a perspective view of the bag tie dispenser of the present invention.

With reference now to the drawings, and in particular to FIG. 1 thereof, a new and improved bag tie dispenser embodying the principles and concepts of the present invention and generally designated by the reference numeral 10 will be described.

More specifically, it will be noted that the first embodiment 10 of the invention includes a hollow generally rectangular housing 12. A lid 14 is removably received on a top portion of the housing 12. The lid 14 provides a storage receptacle 16 for individual bag tie closure strips. The top portion of the housing 12 is provided with an upwardly extending flange 18 for interfitting engagement with cooperating structure provided on the bottom surface of the lid 14. Inside the top portion of the housing 12, a feed hopper for a series of interconnected wire bag tie closure strips is provided. The feed hopper has a straight vertical back wall 20 which is connected to a curved support surface 22. An aperture 24 is provided through a front wall of the housing 12, and communicates with the feed hopper. A slidable cover 26 on the housing 12 is selectively positionable for opening and closing the aperture 24. A generally horizontal slot 28 extends transversely through a lower portion of the front wall of the housing 12. A control knob 30 is mounted adjacent a side wall of the housing 12.

Figure 2:
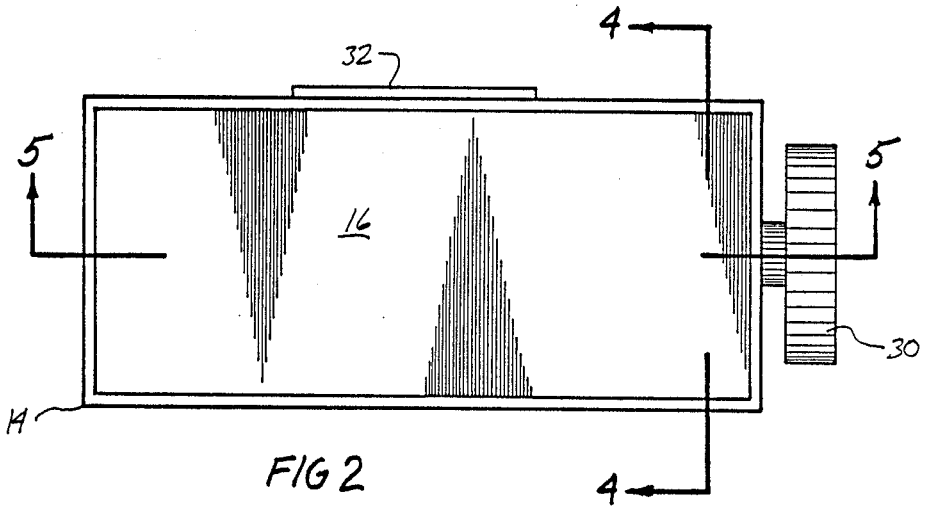
FIG. 2 is a top view of the bag tie dispenser of the present invention.

As shown in FIG. 2, an adhesive securing strip 32 is provided on a back wall of the housing 12 for securing the dispenser 10 to a vertical surface, for example a kitchen wall or cabinet.

Figure 3:
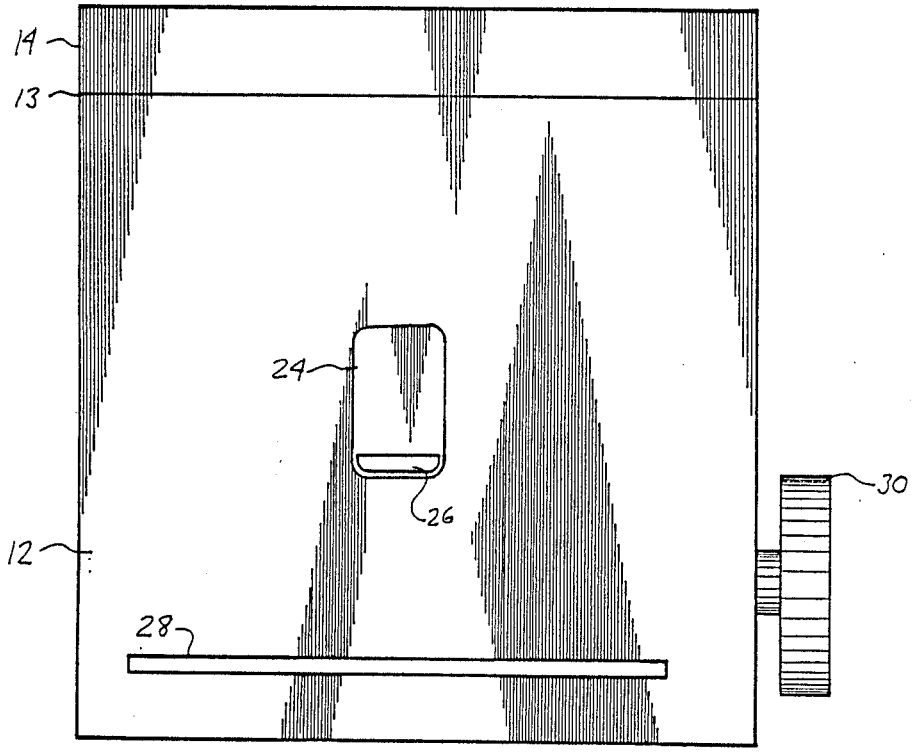
FIG. 3 is a front view of the bag tie dispenser of the present invention.

In the front view of FIG. 3, it may be seen that the lid 14 forms an interfitting connection 13 with the housing 12.

Figure 4:
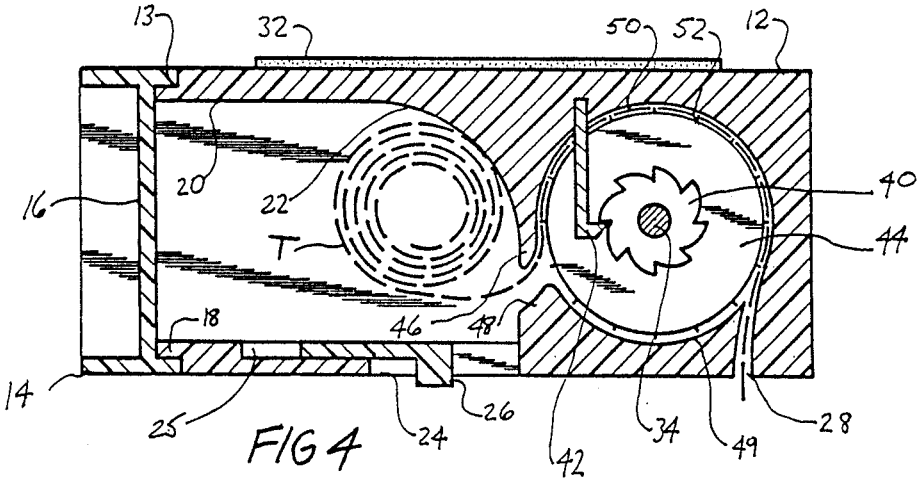
FIG. 4 is a transverse cross sectional view of the bag tie dispenser of the present invention, taken along line 4—4 of FIG. 2.

With reference now to FIG. 4, the internal mechanisms of the bag tie dispenser 10 of the present invention will now be described. A series of interconnected wire bag tie closure strips T are received on the curved supporting surface 22 of the feed hopper within the top portion of the hollow housing 12. The bag tie closure strips T may be in the form of a loose roll or coil as shown, or may be in the form of a flat sheet. The curved supporting surface 22 is connected to a straight vertical back wall 20 of the feed hopper, and terminates in a radiused horizontal guide lip 46. The horizontal guide lip 46 separates the feed hopper from a cylindrical recess 49 which extends transversely adjacent a bottom portion of the housing 12. A slotted feed roller 44 is rotatably mounted on a shaft 34 within the cylindrical recess 49. A series of evenly circumferentially spaced slots 50 extend axially along the outer peripheral cylindrical surface of the feed roller 44. The slots 50 are separated by a series of projections 52 which determine the maximum diameter of the roller 44. The projections 52 are dimensioned to form a very slight spacing between the maximum diameter of the roller 44 and the wall of the cylindrical recess 49. Each of the slots 50 has a width of about three thirty seconds of an inch and depth of about three hundredths of an inch. These dimensions are critical to the proper functioning of the bag tie dispenser 10 of the present invention. A ratchet wheel 40 is mounted for rotation with the shaft 34 and feed roller 44. A pawl 42 is formed from a resilient strip of spring steel and is mounted within the housing 12 for cooperation with the ratchet wheel 40, as shown. The ratchet wheel 40 is dimensioned in accordance with the width of the slots 50, such that one incremental rotation of the wheel corresponds with the dispensing of a single bag tie strip. The horizontal slot 28 connects tangentially with the cylindrical recess 49. An arcuate guide projection 48 is spaced from the radiused guide lip 46 and forms a feed gap therebetween which communicates between the feed hopper and the cylindrical recess 49. The aperture 24 communicates with the feed hopper and allows an individual to initially feed the end of the series of interconnected bag tie closure strips T between the guide lip 46 and guide projection 48, into engagement with the slotted feed roller 44.

In use the consumer first utilizes the adhesive mounting strip 32 to attach the dispenser 10 to a vertical wall surface. The lid 14 is then removed from the housing 12 and a loose coil or flat strip of interconnected bag closure strips T is inserted int the feed hopper in the top portion of the housing 12. The lid 14 is then replaced on the top portion of the housing 12, n engagement with the upstanding flange 18 of the housing 12, o form a frictionally interfitting joint 13. The series of ba ties T rests on the curved supporting surface 22, by virtue of gravity. The consumer then opens the slidable cover 26 on the front wall of the housing 12 and inserts a finger through the aperture 24 and feeds the end of the series of interconnected bag ties T between the radiused guide lip 46 and arcuate guide projection 48. By rotating the control knob 30 in a clockwise direction, the bag tie closure strips will be frictionally engaged between the maximum diameter projections 52 on the feed roller 44 and the cylindrical inner wall of the recess 49. The wire body portion of each strip will be received in the slots 50 of the feed roller 44. By virtue of the critical dimensioning of the feed roller 44, the thin paper edge portions of each of the bag tie closure strips will be pinched between the maximum diameter projections 52 and the inner cylindrical wall of the recess 49. The control knob 30 is initially rotated in a clockwise direction until a single bag closure strip projects through the front horizontal slot 28. The individual closure strip may now be easily separated and utilized. The ratchet wheel 40 and cooperating pawl 42 ensure that a single bag tie closure strip may be easily dispensed, merely by rotating the control knob 30 one "click".

Figure 5:
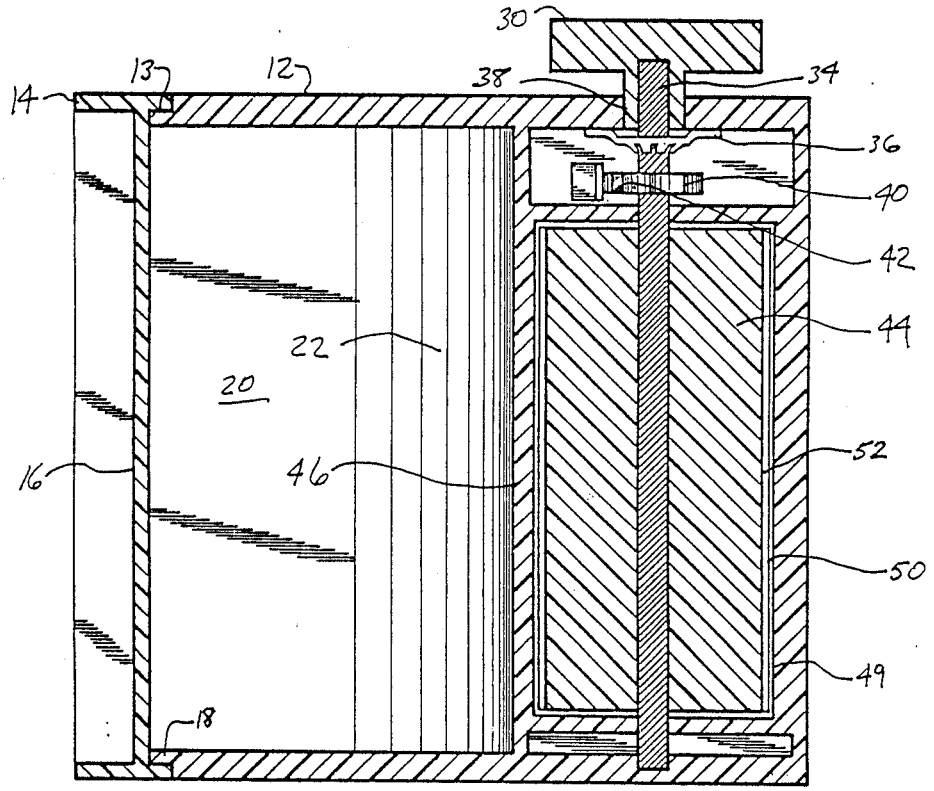
FIG. 5 is a longitudinal cross sectional view of the bag tie dispenser of the present invention, taken along line 5—5 of FIG. 2.

In FIG. 5, a longitudinal cross sectional view is provided, which further illustrates the internal mechanisms of the bag tie dispenser 10 of the present invention.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A new and improved bag tie dispenser, comprising:

a hollow generally rectangular housing;

a lid removably received on a top portion of said housing;

a loose tie storage receptacle on an upper surface of said lid;

said housing having a tie feed hopper with a straight back vertical interior wall;

a lower portion of said back vertical wall connected by a curved support surface to a generally horizontal radiused guide lip;

a cylindrical recess in said housing disposed beneath said horizontal radiused guide lip;

a feed gap communicating between said tie feed hopper and said cylindrical recess;

a cylindrical feed roller rotatably mounted in said cylindrical recess;

said feed roller having an outer peripheral surface provided with a plurality of axially extending evenly circumferentially spaced slots;

each of said slots having a width of about three thirty seconds of an inch and a depth of about three hundredths of an inch;

said feed roller having a maximum diameter dimensioned to form a slight spacing between said roller and a wall of said cylindrical recess;

a generally horizontal slot formed through a front wall of said housing;

said slot tangentially connected with said cylindrical recess;

an aperture formed through said front housing wall;

said aperture in communication with said tie feed hopper;

a slidable cover on said housing for selectively opening and closing said aperture;

means for manually rotating said feed roller; and adhesive means on a back exterior wall of said housing for securing said dispenser to a vertical surface.

2. The bag tie dispenser of claim 1, further comprising ratchet wheel means mounted for rotation with said slotted feed roller; and pawl means in said housing in engagement with said ratchet wheel means.

3. A new and improved bag tie dispenser, comprising:

a hollow housing;

a lid removably received on a top portion of said housing;

a loose tie storage receptable on an upper surface of said lid;

said housing having a tie feed hopper with a straight back vertical interior wall;

a lower portion of said back vertical wall connected by a curved support surface to a generally horizontal radiused guide lip;

a cylindrical recess in said housing disposed beneath said horizontal radiused guide lip;

a feed gap communicating between said tie feed hopper and said cylindrical recess;

a cylindrical feed roller rotatably mounted in said cylindrical recess;

said feed roller having an outer peripheral surface provided with a plurality of axially extending evenly circumferentially spaced slots;

said feed roller having a maximum diameter dimensioned to form a slight spacing between said roller and a wall of said cylindrical recess;

a slot formed through a front wall of said housing;

said slot tangentially connected with said cylindrical recess;

an aperture formed through said front housing wall;

said aperture in communication with said tie feed hopper;

a slidable cover on said housing for selectively opening and closing said aperture;

means for manually rotating said feed roller; and means on a back exterior wall of said housing for securing said dispenser to a vertical surface.

* * * * *